US011717103B2

(12) United States Patent
Ford et al.

(10) Patent No.: US 11,717,103 B2
(45) Date of Patent: Aug. 8, 2023

(54) HANGER

(71) Applicant: FORD INVEST PTY LTD, Athelstone (AU)

(72) Inventors: David Ford, Athelstone (AU); Matthew Ford, Athelstone (AU)

(73) Assignee: FORD INVEST PTY LTD, Athelstone (AU)

( * ) Notice: Subject to any disclaimer, the term of this patent is extended or adjusted under 35 U.S.C. 154(b) by 265 days.

(21) Appl. No.: 16/639,068

(22) PCT Filed: Aug. 16, 2018

(86) PCT No.: PCT/AU2018/050869
§ 371 (c)(1),
(2) Date: Feb. 13, 2020

(87) PCT Pub. No.: WO2019/033167
PCT Pub. Date: Feb. 21, 2019

(65) Prior Publication Data

US 2020/0221891 A1 Jul. 16, 2020

(30) Foreign Application Priority Data

Aug. 16, 2017 (AU) ..... 2017903281

(51) Int. Cl.
*A47G 25/18* (2006.01)

(52) U.S. Cl.
CPC ..... *A47G 25/18* (2013.01)

(58) Field of Classification Search
CPC ..... A47G 25/18; A47G 25/183; A47G 25/186
See application file for complete search history.

(56) References Cited

U.S. PATENT DOCUMENTS 1,701,783 A * 2/1929 Law ..... A47G 25/746 211/85.3
1,944,343 A 1/1934 Herman
2,138,914 A * 12/1938 Frey ..... A47G 25/746 211/120
2,397,291 A * 3/1946 Robertson ..... F16L 3/223 D8/356
2,430,624 A * 11/1947 Vollmer ..... A47G 29/08 211/89.01
2,643,840 A * 6/1953 Lanman ..... A47G 1/168 248/467
2,960,262 A * 11/1960 Cavender ..... A47G 25/28 223/98
3,054,538 A * 9/1962 Rubin ..... A47G 25/24 D6/319
4,244,544 A * 1/1981 Kornat ..... F16L 3/13 248/68.1
5,915,573 A * 6/1999 Drower ..... A47B 81/00 211/89.01
2020/0221891 A1* 7/2020 Ford ..... A47G 25/28

FOREIGN PATENT DOCUMENTS

GB 2057857 A * 4/1981 ..... B25H 3/04
GB 2057857 6/1999

* cited by examiner

*Primary Examiner* — Ismael Izaguirre
(74) *Attorney, Agent, or Firm* — Workman Nydegger

(57) ABSTRACT

A hanger for items of clothing comprises a rigid support member (12) and a hanging portion (14). The 5 hanging portion comprises a plurality of clamping elements (16) which are resiliently movable to receive, hold and release clothing items therebetween and are arranged in a line in side-by-side relationship extending from the rigid support member.

12 Claims, 7 Drawing Sheets

SECTION A-A

HANGER

CROSS-REFERENCE TO RELATED APPLICATIONS

This application claims priority to PCT Application No. PCT/AU2018/050869 filed Aug. 16, 2018, entitled "A HANGER", which claims the benefit of and priority to Australian Patent Application No. 2017903281, filed on Aug. 16, 2017, the entirety of each of which are incorporated herein by reference.

FIELD OF THE INVENTION

The present invention relates to a hanger for items of clothing.

In particular, the present invention relates to a hanger for small clothing items including, by way of example, socks, panties, wash cloths, sports uniforms, dish towels, baby clothes, bikinis, knickers, handkerchiefs.

The present invention also relates to a method of manufacturing a hanging portion of a hanger for items of clothing and to the as-manufactured hanging portion.

The present invention also relates to a method of manufacturing a hanger for items of clothing and to the as-manufactured hanger.

BACKGROUND

The standard practice for hanging items of washed clothing on a clothes line to dry comprises using pegs to hold the items on the clothes line.

This can be a time-consuming exercise for small items of clothing, such as socks, panties, wash cloths, sports uniforms, dish towels, baby clothes, bikinis, knickers, and handkerchiefs. This is particularly the case if there is a large number of small items to be hung on a clothes line.

There is a need for an alternative system and method that makes it easier to hang up small items of clothing.

The above description is not an admission of the common general knowledge in Australia.

SUMMARY OF THE INVENTION

In broad terms, the invention provides a hanger for items of clothing comprising:

a rigid support member and a hanging portion mounted to the rigid support member and comprising clamping elements which are resiliently movable to receive, hold and release clothing items therebetween.

The invention provides a hanger for items of clothing comprising:

a rigid support member and a hanging portion comprising a plurality of clamping elements which are resiliently movable to receive, hold and release clothing items therebetween and are arranged in a line in side-by-side relationship extending from the rigid support member.

The rigid support member and the hanging portion may be integrally formed.

For example, the rigid support member and the hanging portion may be integrally formed in a series of moulding operations, with the hanging portion molded first and the rigid support member over-moulded onto the hanging portion.

The rigid support member and the hanging portion may be formed separately and assembled together.

For example, the hanging portion may be mounted to the rigid support member.

In some embodiments, the rigid support member comprises a channel that receives and supports at least a portion of the hanging portion.

In some embodiments, the hanging portion may comprise a backing strip for the clamping elements.

The backing strip may be adapted to slide in and be supported by the channel of the rigid support member.

In some embodiments, the clamping elements are resilient clamping elements that are biased towards a closed, clamping position in an as-manufactured form of the hanger.

The clamping elements may be resilient clamping elements that are biased to a closed, clamping position in which adjacent clamping elements are in contact with each other in an as-manufactured form of the hanger.

The clamping elements may comprise a continuous length of a material, typically a resilient material, formed with side-by-side folds (which could also be described as "loops") in a concertina arrangement, with the adjacent folds defining the clamping elements arranged in a line of clamping elements.

Adjacent folds may define a narrow opening, which may be biased to a closed position, for receiving a clothing item, with the clothing item in use being inserted into the opening against the resilience of the adjacent folds and retained between the adjacent folds by the resilience of the adjacent folds, with the resilience of the adjacent folds applying an inward clamping force to the clothing item.

The folds may be defined by inner and outer curved webs and clamping sides interconnecting the webs, with the inner curved webs being connected to the backing strip and the outer curved webs defining outwardly curved surfaces that space apart the openings along the length of the line of clamping elements.

In some embodiments, the clamping elements comprise teeth for gripping items therebetween.

In some embodiments, the hanger further comprises at least one attachment member to secure the hanger to a support structure.

The support structure may be any suitable structure.

By way of example, the support structure may be a conventional structure for supporting items of clothing such as a washing line, bar, and airer rail. The support structure may also be a shower screen or wall.

In some embodiments, the attachment member may be part of or attachable to the hanging portion.

In some embodiments, the attachment member may be a double-sided adhesive tape that can be attached to a rear surface of the rigid support member and to the support structure.

By way of example, the adhesive tape may be a tape that is known as a "Nano Grip" tape or a "micro suction" tape. One supplier of such tapes is Xinstape, and the product is xinst29000B, which has a permanent adhesive VHB on one side with a protective peelable film applied, a 0.8-1 mm thick middle layer of an acrylic foam, and a nano grip adhesive on the other side with a peelable film. The invention is not limited to the use of adhesive tapes of this type and from this specific supplier.

In some embodiments, the attachment member may be part of the rigid support member.

For example, the rigid support member may comprise at least one attachment member in the form of a hook-shaped formation for attaching the hanger to the support structure.

In some embodiments, attachment member may be a separate component to the rigid support member and the hanging portion and be attachable to one or other of these components, with the hanger being an assembly of the components.

For example, the attachment member may be a suction cup or a magnetic element that is attachable to the rigid support member and to the support structure.

By way of example, the suction cup may be an injection moulded one-piece unit that has a suction cup element to attach the unit to the support structure and is also formed to slide onto an end of the rigid support member. It can be appreciated that, with this arrangement, a pair of suction cups, one at opposite ends of the rigid support member could mount the rigid support member and thereby the hanger to the support structure.

By way of further example, the attachment member may be an elongated strip of resilient material comprising a first end and a second end, with the first end comprising a first aperture and the second end comprising a second aperture, wherein the first aperture and the second aperture are connectable by a fastening means thereby securing the hanger to the support structure.

The fastening means may include a protrusion formed in the hanging portion of the hanger adapted to receive the first aperture and the second aperture of the attachment member with the attachment member forming a loop around the support structure thereby securing the hanger to the support structure.

In some embodiments, the second end of the attachment member comprises multiple apertures spaced at different distances from the first aperture so that the attachment member forms folds of different sizes that can fit different sized support structures.

The attachment member may be integrally formed with or separate and attachable to the rigid support member and/or with the hanging portion.

In some embodiments, the rigid support member is made of metal or hard plastic.

The invention also provides a method of manufacturing a hanging portion of a hanger for items of clothing, with the hanging portion comprising a backing strip and a continuous length of a material, typically a resilient material, formed with side-by-side folds in a concertina arrangement which define the clamping elements, with the method comprising injection moulding the hanging portion as a one-piece unit in a curved form along the length of the hanging portion from a suitable plastics material.

Forming the hanging portion in a curved form makes it possible to injection mould the hanging portion as a one-piece unit. The injection moulding process necessarily requires that adjacent clamping elements be formed with a gap between the elements. Typically, the gap is at least 0.8 mm. A gap of at least 0.8 mm is not desirable from the perspective of the clamping function of clamping elements. Specifically, it is preferable that the adjacent folds that form the clamping elements be biased inwardly towards each other, and preferably are in contact in an as-manufactured form of the hanger, to apply an inward clamping force to grip items of clothing in use of the hanger. Optimally, the arrangement is such that the inward clamping force brings the folds into contact with each other. Forming the folds with a gap of at least 0.8 mm limits the clamping force that can be applied. However, when assembling a hanger with the curved hanging portion, sliding the backing strip of the hanging portion into the channel of the rigid support member of the hanger causes the hanging portion into a straight rather than a curved form or otherwise assembling the rigid support member and the hanging portion together so that the hanging portion is in a straight rather than a curved form. This biasing of the curved form to a straight form necessarily biases adjacent clamping elements, i.e. folds, towards each other and closes the gap at least partially and typically completely and increases the inward clamping force of the clamping elements.

The curvature of the as-manufactured hanging portion may be selected as required so that the clamping elements have a required clamping force.

The method may include manufacturing the hanging portion in a series of moulding steps, with the hanging portion being moulded in a first step and the rigid support member being over-moulded onto the hanging portion in a second step.

The invention also provides a hanging portion of a hanger for items of clothing, with the hanging portion comprising a backing strip and a continuous length of a material, typically a resilient material, formed with side-by-side folds in a concertina arrangement which define the clamping elements, with the as-manufactured form of the hanging portion being a one-piece unit that is curved along the length of the hanging portion with clamping elements being in side-by-side relationship along the length.

The invention provides a hanger for items of clothing comprising:

a rigid support member and a hanging portion mounted to the rigid support member and comprising clamping elements which are resiliently movable to hold and release clothing items therebetween.

BRIEF DESCRIPTION OF THE DRAWINGS

In order that the invention may be more clearly ascertained, embodiments are now described, by way of example, with reference to the accompanying drawings, in which:

FIGS. 5A to 5D shows the attachment member of the embodiment of FIG. 2; wherein:

FIG. 5A shows a view of the attachment member along section A-A of FIG. 5B, FIG. 5B shows a top plan view of the attachment member;

FIG. 5C shows a side view of the attachment member, and

FIG. 5D shows a perspective view of two attachment members;

DETAILED DESCRIPTION OF EMBODIMENTS OF THE INVENTION

Figure 1:
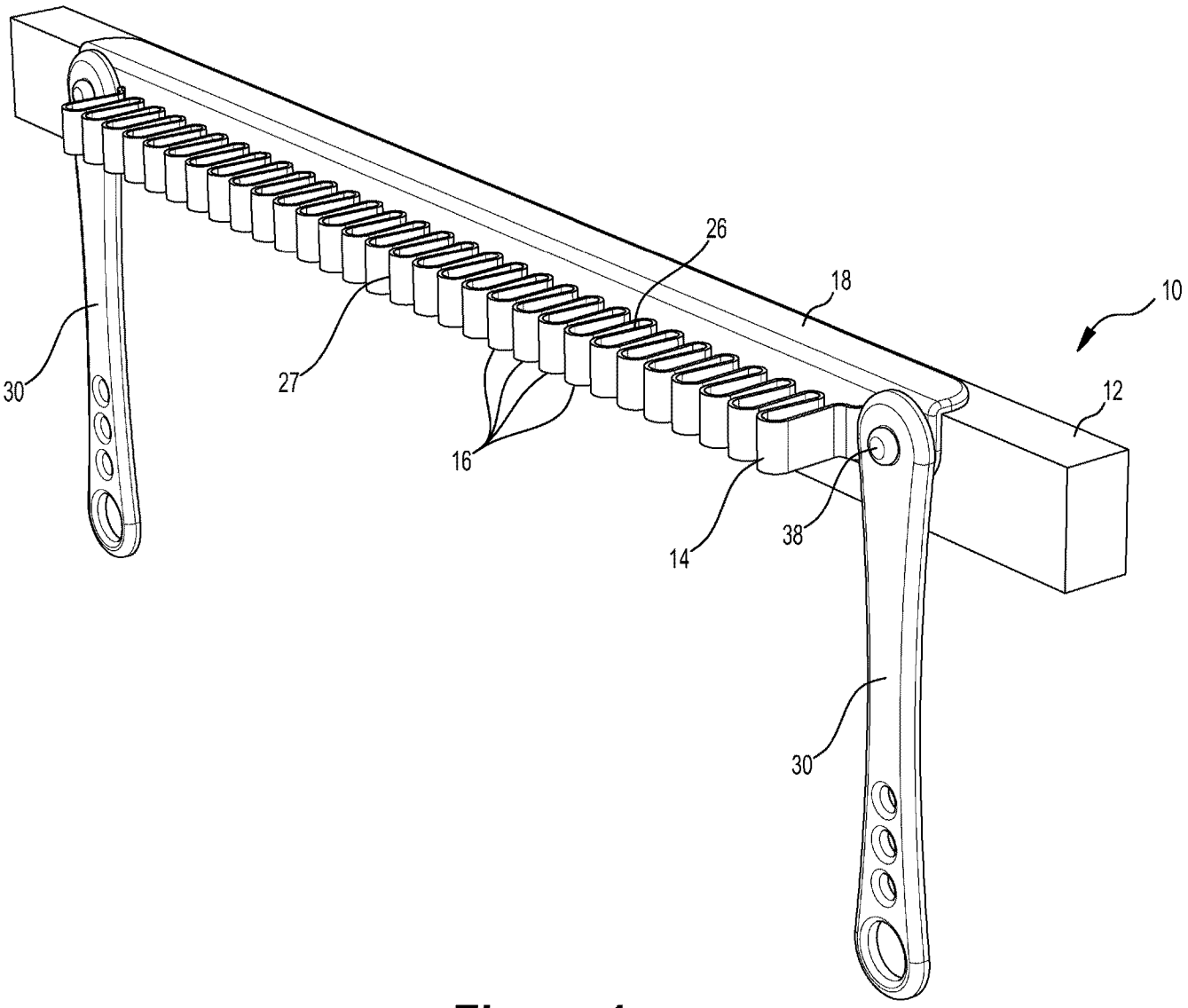
FIG. 1 shows a perspective view of a first embodiment of a hanger in accordance with the invention.

The first embodiment of the hanger 10 shown in FIG. 1 comprises a rigid support member 12 and a hanging portion 14 mounted to the rigid support member 12.

The hanging portion 14 comprises a plurality of clamping elements 16 which are resiliently movable to allow clothing items, such as socks, to be inserted between adjacent clamping elements 16 against the resilience of the clamping elements 16 and held by the clamping elements as a consequence of the resilience of the clamping elements 16.

In the described embodiment of FIG. 1, the rigid support member 12 comprises a hook-shaped formation 18 for attaching the hanger 10 to a support structure 22 such as a washing line, bar, airer rail etc. In this way the hanger 10 can be easily clipped or otherwise attached to the support structure 22, thereby making the hanger 10 a helpful product that can be used with existing structures found in every household.

In the first embodiment described in FIG. 1, the rigid support member 12 and the hanging portion 14 are integrally formed, for example injection moulded from a suitable plastics material.

Figure 7:
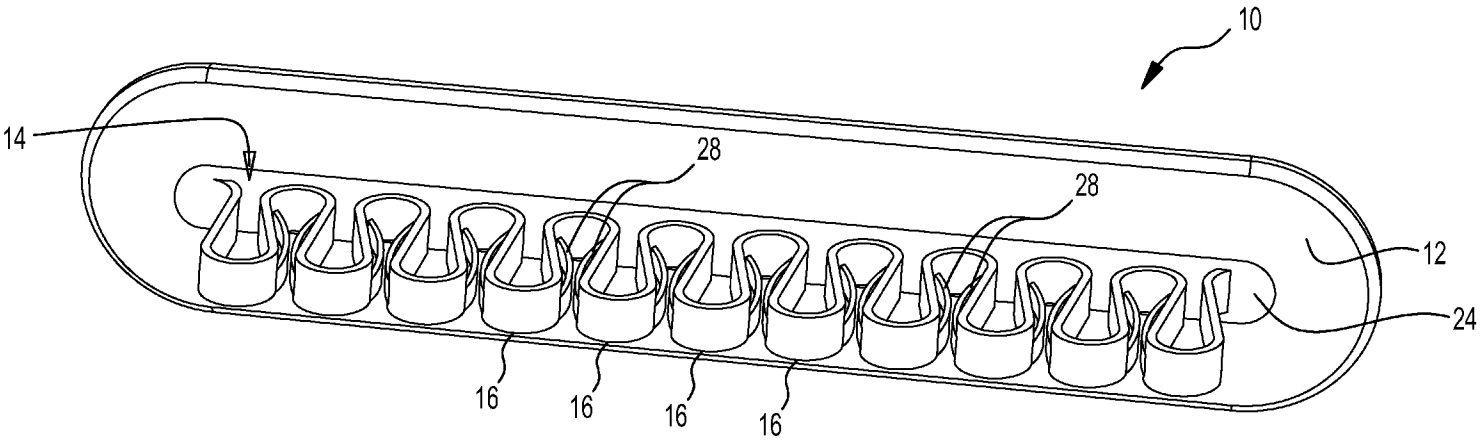
FIG. 7 shows a perspective view of a third, but not the only other, embodiment of a hanger in accordance with the invention.
Figure 8:
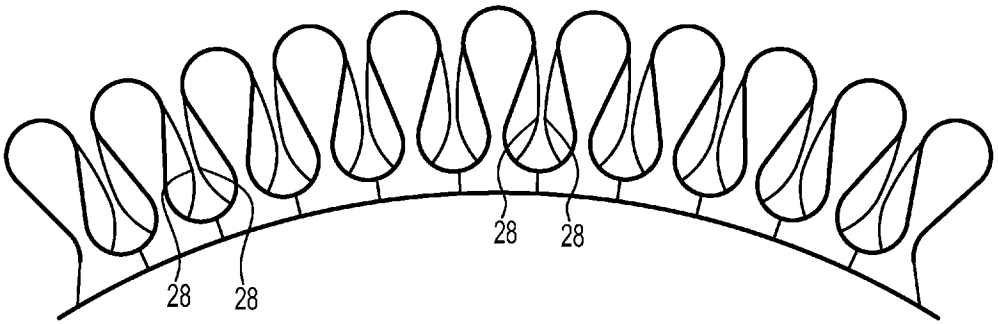
FIG. 8 shows the hanging portion of the embodiment of FIG. 7 in an as-injection moulded form.

This is also the case with the third embodiment shown in FIGS. 7 and 8. With reference to FIG. 7, in the third embodiment the rigid support member 12, which is essentially an elongate plate, is over-moulded onto the hanging portion 14.

With reference to FIGS. 7 and 8, the hanging portion 14 comprises a backing strip 24 for the clamping elements 16. The backing strip 24 and the clamping elements 16 are injection moulded as one curved unit—as shown in FIG. 8 and described further below. The backing strip 24 and the clamping elements 16 are suitably injection moulded from polypropylene. The backing strip 24 provides a load bearing support for the clamping elements 16 when clothing items are inserted between and held by adjacent clamping elements 16.

Figure 2:
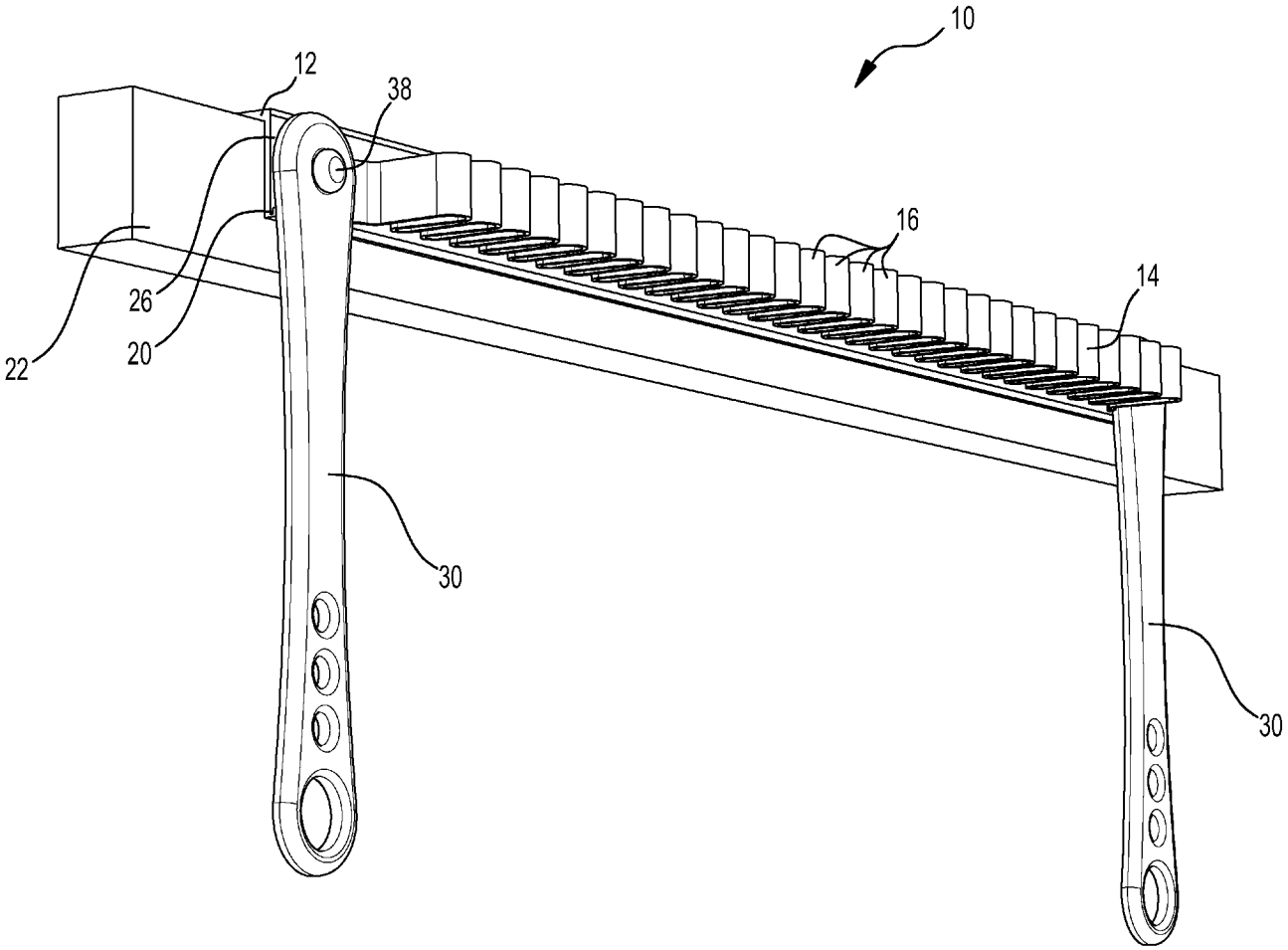
FIG. 2 shows a perspective view of a second embodiment of a hanger in accordance with the invention.

However, in a second although not the only other embodiment, shown for example in FIG. 2, the rigid support member 12 and the hanging portion 14 are individual items that are assembled together.

Specifically, as is shown in FIGS. 2 to 5, the rigid support member 12 comprises a U-shaped channel 20 that receives and supports at least a portion of the hanging portion 14.

In particular, in the described second embodiment of FIGS. 2 to 5, the hanging portion 14 comprises a backing strip 24 for the clamping elements 16. The backing strip 24 can be either integrally formed with the clamping elements 16 or be attached thereto. The backing strip 24 provides a load bearing support for the clamping elements 16 when clothing items are inserted between and held by adjacent clamping elements 16.

The backing strip 24 and the clamping element 16 are suitably made of polypropylene or any other suitable material. The rigid support member 12 is suitably made of metal, such as aluminium, or a hard plastics material. Any other suitable materials can be used.

As shown in FIG. 2 the backing strip 24 of the hanging portion 14 is adapted to slide in and be supported by the channel 20 of the rigid support member 12. The support member 12 provides the required rigidity to the backing strip 24, and in turn to the clamping elements 16, so that unwanted bending is avoided.

Figure 3:
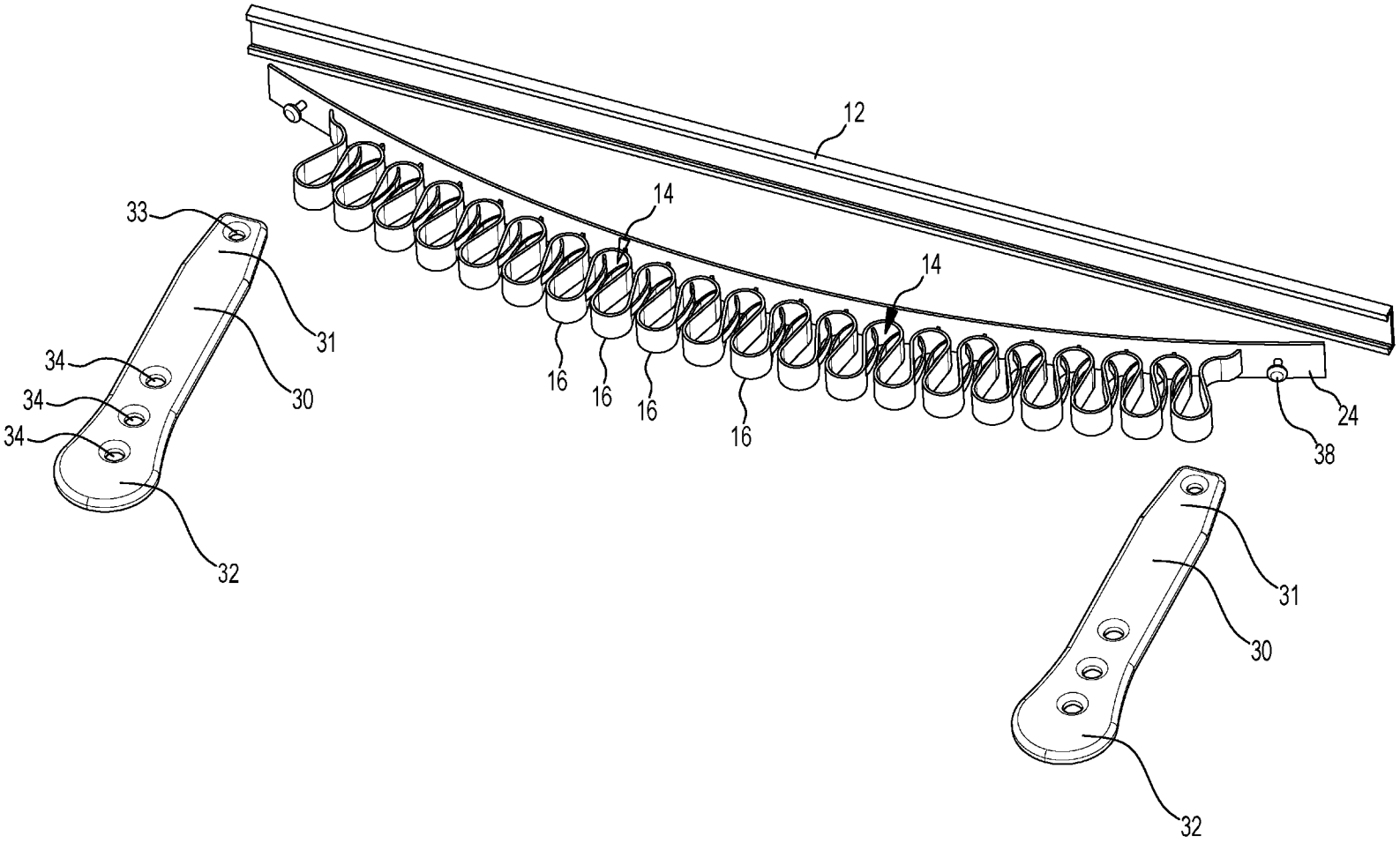
FIG. 3 shows an exploded view of the embodiment of FIG. 2.

FIG. 3 shows that the hanging portion 14 of the second embodiment is curved in the as-manufactured form of the hanging portion 14. FIG. 8 shows that the hanging portion 14 of the third embodiment is curved in the as-manufactured form of the hanging portion 14.

Specifically, in both embodiments, the hanging portion 14 is injection moulded as a curved member from a suitable plastics material such as polypropylene.

The hanging portion 14 is deliberately moulded as a curved member in the second and third embodiments. Forming the hanging portion 14 in a curved form makes it possible to injection mould the hanging portion 14 as a one-piece unit. The injection moulding process necessarily requires that adjacent clamping elements 16 be formed with a gap between the elements. Typically, the gap is at least 0.8 mm, again due to constraints in injection moulding equipment. A gap of at least 0.8 mm is not desirable from the perspective of the clamping function of adjacent clamping elements 16. Specifically, it is preferable that the adjacent folds that form the clamping elements 16 be biased inwardly towards each other, and preferably are in contact in the as-manufactured form of the hanger, to apply an inward clamping force to grip items of clothing in use of the hanger. Optimally, the arrangement is such that the inward clamping force brings the folds into contact with each other. Forming the folds with a gap of at least 0.8 mm limits the clamping force that can be applied. However, when assembling a hanger with the curved hanging portion sliding the backing strip 24 into the channel 20 of the rigid support member 12 causes the curved hanging portion 14 into a straight rather than a curved form. This biasing of the curved form to a straight form necessarily biases adjacent clamping elements 16 towards each other and closes the gap at least partially and typically completely and increases the inward clamping force of the clamping elements 16.

The curvature of the as-manufactured hanging portion 14 of the second and third embodiments may be selected as required so that the clamping elements 16 have a required clamping force.

It can be appreciated that the curvature has a positive effect on manufacturing the hanging portion 14 and on the clamping action of adjacent clamping elements 16.

The support member 12 of the second and third embodiments provides a flat surface for the hanging portion 14 that compensates for possible uneven support structures 22.

In each of the first, second, and third embodiments above described, the clamping elements 16 are folds (which can also be described as "loops") of resilient material, with adjacent folds providing a clamping action.

In each of the first, second, and third embodiments, as shown in the Figures, the clamping elements 16 are a continuous length of material formed with side-by-side folds in a concertina arrangement.

The folds define the clamping elements 16. The folds are defined by inner and outer curved webs 26 and clamping sides 27 interconnecting the webs 26. The arrangement is such that adjacent folds define a narrow opening, which may be biased to a closed position, for receiving a clothing item, with the clothing item in use being inserted into the opening against the resilience of the adjacent folds and retained between the adjacent folds by the resilience of the adjacent folds applying an inward clamping force to the clothing item.

As is the case with the second and third embodiments, in the described first embodiment of FIG. 1, the hanging portion 14, and therefore the clamping elements 16, is injection moulded as a one-piece unit from a suitable resilient plastics material.

In other embodiments of the invention that are not shown in the Figures, the clamping elements 16 are separately formed and then assembled.

The inner curved webs 26 of each clamping element 16 are connected to the hook-shaped formation 18 in the case of the first embodiment and to the backing strip 24 in the case of the second and third embodiments, and the clamping sides 27 extend from the backing strip 24, with adjacent clamping sides 27 defining clamping surfaces so that clothing items can be received and held therebetween. The arrangement is such that the outer curved webs 26 essentially define the narrow openings and, by virtue of being outwardly curved as viewed in use, facilitate guiding clothing items into the openings.

As noted above, in some other embodiments, the clamping sides 27 of the folds are in contact and have to be moved apart against the resilience of the folds to allow clothing items to be inserted and hung from the hanger 10.

In the second and third embodiments, particularly as shown in FIGS. 2 to 4B, 7, and 8, the clamping elements 16 also comprise additional closed folds 28 located toward the backing strip 24 that provide extra tension to the clamping sides 27 and thereby increase the inward bias of the clamping sides 27 of the folds. In addition, the closed folds 28 increase the surface area of contact of the clamping sides 27 with clothing items, thereby improving the gripping action of the clamping elements 16.

The inner web 26 of each fold is integrally moulded with the support member 12.

The number of folds can vary as desired.

Figure 4A:
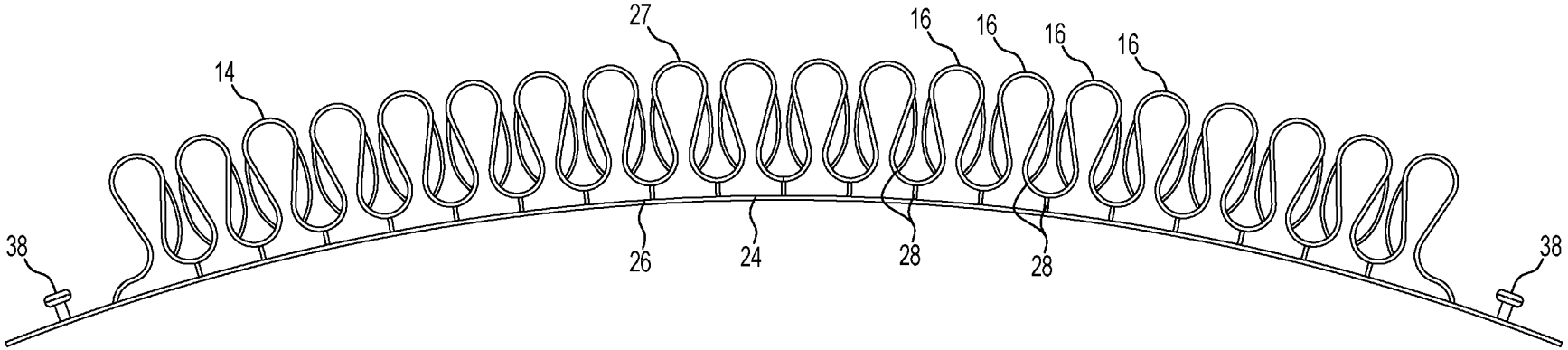
FIG. 4A shows the hanging portion of the embodiment of FIG. 2.
Figure 4B:
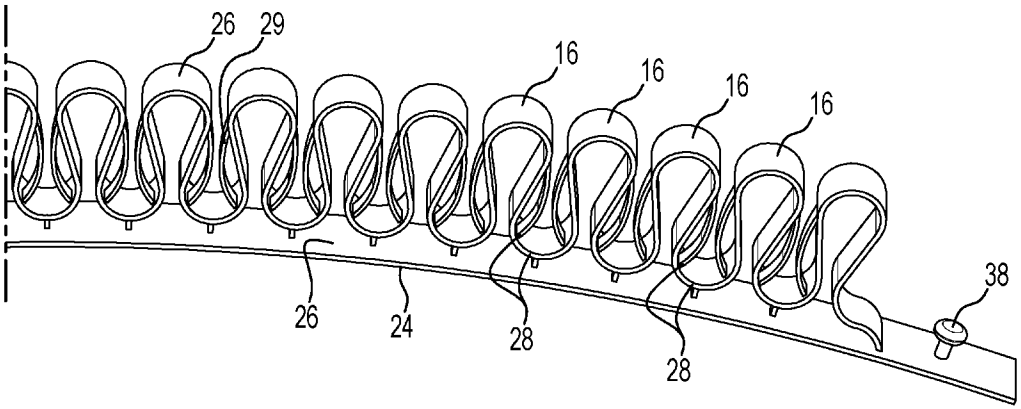
FIG. 4B shows a magnified view of the boxed area in FIG. 3A.
Figures 5A, 5B, 5C, 5D:
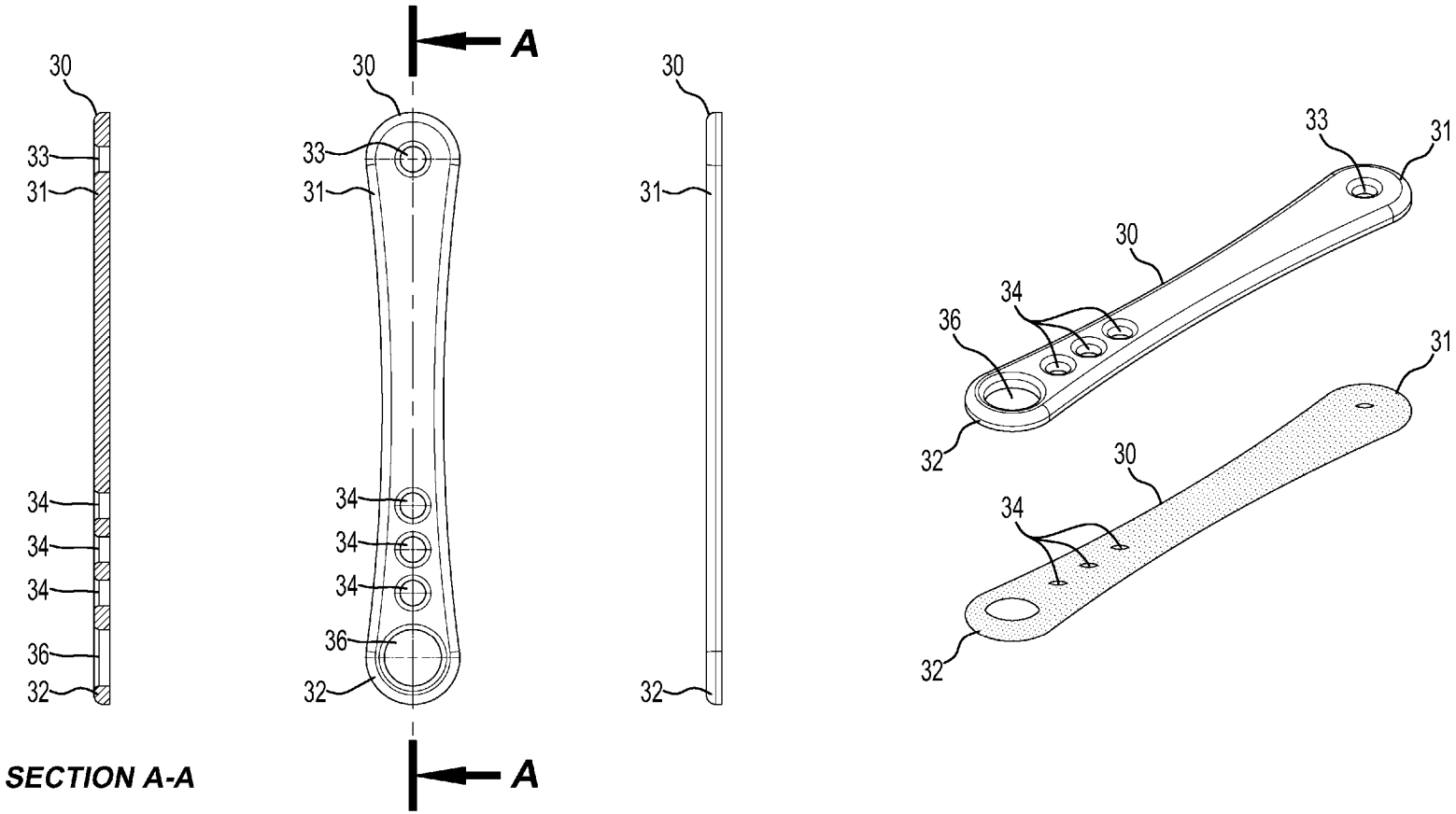

As more clearly shown in FIGS. 4A and 4B the clamping elements 16 of the second embodiment comprise teeth 29 extending from one or both opposite faces of adjacent clamping sides 27 for gripping clothing items therebetween. The teeth 29 are, in the described embodiment, small protrusions of resilient material that deform under a pulling or pushing force, thereby assuring grip of items between adjacent clamping sides 27 without damaging or tearing the hold item. The teeth 29 are inwardly bent by the insertion of a clothing item. The resiliency of the teeth firmly grips the inserted item to frictionally hold the same between adjacent clamping sides 27. When the clothing item is pulled out the teeth 29 bend outwardly and, when the item is removed, they return to their original form.

FIG. 3 shows the hanging portion 14 and the support member 12 of the second embodiment. In addition, the Figure shows an attachment member 30 to secure the hanger 10 to a support structure 22.

As more clearly shown in FIGS. 5A to 5D, in the second embodiment, the attachment member 30 is an elongated strip of resilient material comprising a first end 31 and a second end 32, with the first end 31 comprising a first aperture 33 and the second end 32 comprising a second aperture, wherein the first aperture 33 and the second aperture 34 are connectable by a fastening means 38 thereby securing the hanger 10 to a support structure 22.

The apertures 31, 32 can have different dimensions to fit different sized fastening means 38.

The second embodiment comprises two attachment members 30 in the form of separate element that can be attached at two end of the hanger 10 to provide further stability. However, a single attachment member or a plurality of attachment members may be used.

In the second embodiment particularly as shown in FIGS. 5A to 5D, the second end 32 of the attachment member 30 further comprises a section 36 for accommodating imprinted logos or identification numbers.

The second end 32 of the attachment member 30 comprises three apertures 34, 34', 34" spaced at different distances from the first aperture 33 so that the attachment member 30 forms folds of different sizes that can fit different sized support structures 22. The second end 32 of the attachment member 30 can include any number of desired apertures.

Referring to FIG. 6A to 6E, in the second embodiment, the fastening means 38 is a protrusion formed in the hanging portion 14 of the hanger 10 adapted to receive the first aperture 33 and the second aperture 34 of the attachment member 30 with the attachment member 30 forming a loop around the support structure 22 thereby securing the hanger 10 to the support structure 22.

Figure 6A:
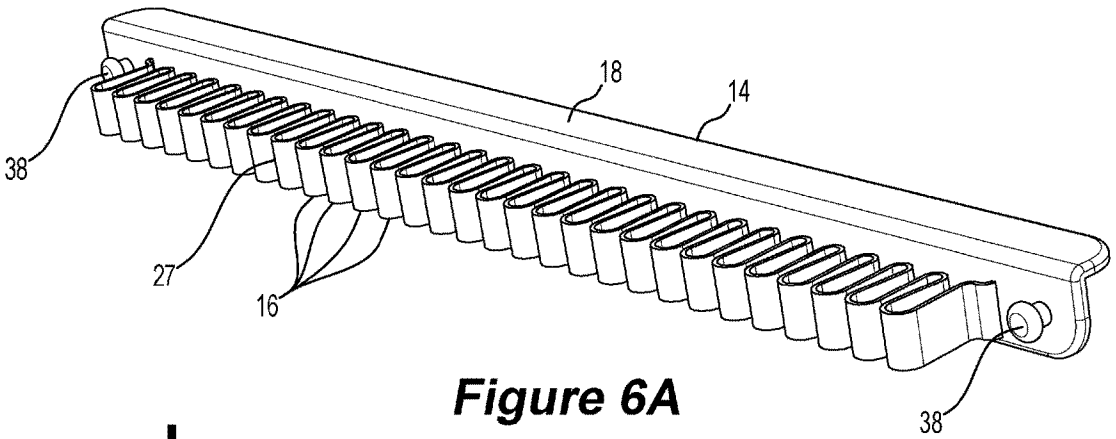
FIG. 6A shows a perspective view of the hanging portion of the embodiment of FIG. 1.
Figure 6D:
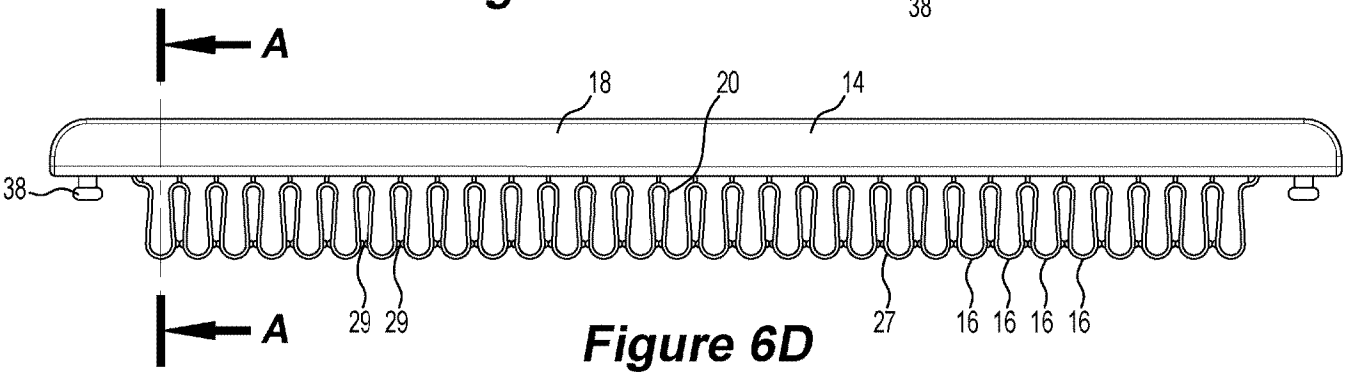
FIG. 6D shows a top plan view of the hanging portion of the embodiment of FIG. 1.
Figure 6E:
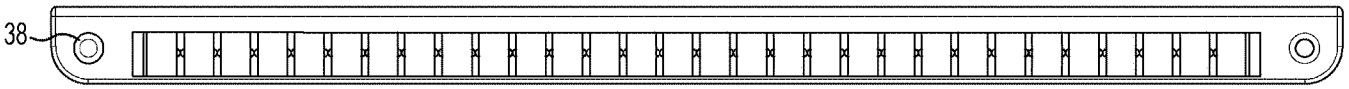
FIG. 6E shows a front view of the hanging portion of the embodiment of FIG. 1.
Figure 6B:
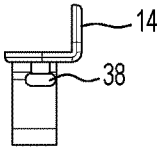
FIG. 6B shows a top plan view of the fastening means of the embodiments of FIGS. 1 and 2.
Figure 6C:
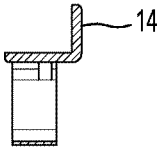
FIG. 6C shows a view of the fastening means of FIG. 6C along section A-A.

The protrusions extend from opposite ends of the hanger and, in the embodiment described in FIGS. 6A, 6D and 6E, are integrally formed with the hanging portion 14. However, in other embodiments the protrusions 38 can be differently spaced. Also, the protrusion can extend from the support member 12.

The above described hanger 10 is portable and easy to mount on different support structures. The structure of the hanger 10 is such that there is a minimal risk of damage to items of clothing retained by the hanger 10.

Modifications within the scope of the invention may be readily made by those skilled in the art. It is to be understood, therefore, that this invention is not limited to the particular embodiments described by way of example hereinabove.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A hanger for items of clothing comprising:

a rigid support member; and a resilient hanging portion comprising a continuous length of material that provides a plurality of loops arranged in a side-by-side relationship, the loops being configured to receive, hold and release clothing items therebetween, with the hanging portion having a curved form in which a gap is present between adjacent loops of the continuous length of material, wherein, in use, the hanging portion is held in a straight form by the support member with the loops projecting outwardly therefrom, such that the loops are biased towards one another and the gap between adjacent loops is reduced to thereby apply an inward clamping force onto clothing items inserted therebetween, wherein the rigid support member and the hanging portion are formed separately and assembled together, and wherein the rigid support member comprises a channel that receives and supports at least a portion of the hanging portion.

2. The hanger of claim 1 wherein the hanging portion further comprises a backing strip that is adapted to slide in and be supported by the channel of the rigid support member, with the opposing ends of the continuous web being connected to the backing strip.

3. A hanger for items of clothing comprising:

a rigid support member; and a resilient hanging portion comprising a continuous length of material that provides a plurality of loops arranged in a side-by-side relationship, the loops being configured to receive, hold and release clothing items therebetween, with the hanging portion having a curved form in which a gap is present between adjacent loops of the continuous length of material, wherein, in use, the hanging portion is held in a straight form by the support member with the loops projecting outwardly therefrom, such that the loops are biased towards one another and the gap between adjacent loops is reduced to thereby apply an inward clamping force onto clothing items inserted therebetween, wherein the continuous length of material comprises side-by-side folds in a concertina arrangement, with the adjacent folds defining the loops and the folds are defined by inner and outer curved webs and clamping sides interconnecting the webs, with the inner curved webs being connected to a backing strip and the outer curved webs defining outwardly curved surfaces that define spaced apart openings along the length of the continuous web.

4. The hanger of claim 3 wherein the loops include teeth for gripping items therebetween.

5. A hanger for items of clothing comprising:

a rigid support member;

a resilient hanging portion comprising a continuous length of material that provides a plurality of loops arranged in a side-by-side relationship, the loops being configured to receive, hold and release clothing items therebetween, with the hanging portion having a curved form in which a gap is present between adjacent loops of the continuous length of material, and at least one attachment member to secure the hanger to a support structure, wherein, in use, the hanging portion is held in a straight form by the support member with the loops projecting outwardly therefrom, such that the loops are biased towards one another and the gap between adjacent loops is reduced to thereby apply an inward clamping force onto clothing items inserted therebetween, wherein the attachment member is part of or attachable to the hanging portion, and wherein the attachment member is part of the rigid support member and wherein the rigid support member preferably comprises at least one attachment member in the form of a hook-shaped formation for attaching the hanger to the support structure.

6. A hanger for items of clothing, comprising:

a rigid support member;

a resilient hanging portion comprising a continuous length of material that provides a plurality of loops arranged in a side-by-side relationship, the loops being configured to receive, hold and release clothing items therebetween, with the hanging portion having a curved form in which a gap is present between adjacent loops of the continuous length of material, and at least one attachment member to secure the hanger to a support structure, wherein, in use, the hanging portion is held in a straight form by the support member with the loops projecting outwardly therefrom, such that the loops are biased towards one another and the gap between adjacent loops is reduced to thereby apply an inward clamping force onto clothing items inserted therebetween, wherein the attachment member is a separate component to the rigid support member and the hanging portion and is attachable to one or other of these components, with the hanger being an assembly of the components, and wherein the attachment member includes a suction cup or a magnetic element that is attachable to the rigid support member and to the support structure, further wherein the suction cup is an injection moulded one-piece unit that has a suction cup element to attach the unit to the support structure and is also formed to slide onto an end of the rigid support member.

7. A hanger for items of clothing, comprising:

a rigid support member;

a resilient hanging portion comprising a continuous length of material that provides a plurality of loops arranged in a side-by-side relationship, the loops being configured to receive, hold and release clothing items therebetween, with the hanging portion having a curved form in which a gap is present between adjacent loops of the continuous length of material, and at least one attachment member to secure the hanger to a support structure, wherein, in use, the hanging portion is held in a straight form by the support member with the loops projecting outwardly therefrom, such that the loops are biased towards one another and the gap between adjacent loops is reduced to thereby apply an inward clamping force onto clothing items inserted therebetween, wherein the attachment member is a separate component to the rigid support member and the hanging portion and is attachable to one or other of these components, with the hanger being an assembly of the components, and wherein the attachment member includes an elongated strip of resilient material comprising a first end and a second end, with the first end comprising a first aperture and the second end comprising a second aperture, wherein the first aperture and the second aperture are connectable by a fastening means thereby securing the hanger to the support structure.

8. The hanger of claim 7, wherein the fastening means is a protrusion formed in the hanging portion of the hanger adapted to receive the first aperture and the second aperture of the attachments member with the attachment member forming a loop around the support structure thereby securing the hanger to the support structure.

9. The hanger of claim 7, wherein the second end of the attachment member comprises multiple apertures spaced at different distances from the first aperture so that the attachment member forms folds of different sizes that can fit different sized support structures.

10. A method of manufacturing a hanging portion of a hanger for items of clothing, with the hanging portion comprising a backing strip and a continuous length of a resilient material, the continuous length of resilient material formed with side-by-side folds in a concertina arrangement which define loops, with the method comprising injection moulding the hanging portion as a one-piece unit in a curved form from a plastic material, further comprising a series of moulding steps, with the hanging portion moulded in a first step and the rigid support member over-moulded onto the hanging portion in a second step.

11. A hanger for items of clothing comprising:

a rigid support member and a resilient hanging portion that includes a plurality of clamping elements that are configured to receive, hold and release clothing items, with the support member having a channel and the hanging portion comprising a backing strip that is receivable within the channel, with the clamping elements projecting outwardly away from the backing strip and being in side-by-side relationship along the length thereof, wherein the hanging portion has a curved form in which a gap is present between adjacent clamping elements and insertion of the backing strip into the channel biases the hanging portion into a straight form where the gap between adjacent clamping elements is reduced to thereby apply an inward clamping force onto clothing items inserted therebetween.

12. The hanger of claim 11, wherein the clamping elements are formed from a continuous length of material that extends along the backing strip and is attached at either end thereto.

* * * * *